United States Patent [19]

Soeffker et al.

[11] Patent Number: 4,686,735

[45] Date of Patent: Aug. 18, 1987

[54] MODULAR CARPET CLEANING APPARATUS

[76] Inventors: Eldred E. Soeffker, 2805 Sycamore La., Plymouth, Minn. 55447; Lou Rukavina, 1659 Maple Knoll Dr., Falcon Heights, Minn. 55113

[21] Appl. No.: 706,667

[22] Filed: Feb. 28, 1985

[51] Int. Cl.[4] ..... A47L 11/30

[52] U.S. Cl. ..... 15/320; 15/353

[58] Field of Search ..... 15/320, 321, 353

[56] References Cited

U.S. PATENT DOCUMENTS

| | | | |
|---|---|---|---|
| 3,040,362 | 6/1962 | Krammes | 15/320 |
| 3,896,520 | 7/1975 | Williams | 15/353 X |
| 4,068,340 | 1/1978 | Forward | 15/321 |
| 4,156,952 | 6/1979 | Lynch | 15/321 X |
| 4,170,805 | 10/1979 | Kumagai | 15/321 |

*Primary Examiner*—Chris K. Moore

[57] ABSTRACT

A carpet cleaning apparatus is provided with a modular construction. A tank module is made up of a vacuum separation tank and a cleaning solution tank, both of which form a uniform cross section. Located at one end of the tank module is a mounting plate which is fastened to a matching mounting plate which in turn mounts the spray and vacuum pumps as well as the vacuum nozzle to form a pump module. The simple yet effective vacuum separation system is provided with directed air and liquid flow. The vacuum is ultimately pulled out of the top of the vacuum separation tank and passes through a tube downwardly through the cleaning solution tank to the pump module. The device is self-contained and easily portable.

20 Claims, 5 Drawing Figures

MODULAR CARPET CLEANING APPARATUS

BACKGROUND OF THE INVENTION

Various carpet cleaning devices have been known which generally provide a means for spraying a cleaning solution on a carpet and thence vacuuming the solution and dirt and the like up into a tank where the liquid and debris are separated from the air in some sort of separation chamber. Such devices as are known are shown in the following U.S. Pat. Nos. 2,986,764, 3,040,362, 3,060,484, 3,639,939, 3,939,527, 3,959,844, 4,114,229 and 4,156,952.

The above devices in general suffer from undue complication so that the devices are unduly heavy and expensive to manufacture. Such devices are also complicated, which impedes servicing and makes manufacturing difficult.

It is therefore an object of this invention to provide a carpet cleaning device which is formed in a modular fashion and which may be easily disassembled for repair and which is also easily and inexpensively manufactured. It is further an object of this invention to provide a device which is relatively simple and which is capable of being utilized in rental situations or for home sales. It is also an object of this invention to provide a device which efficiently spreads the cleaning solution into the carpet and which effectively separates the fluid and debris from the air prior to the vacuum pump.

SUMMARY OF THE INVENTION

A first mounting plate is provided having first and second surfaces. Mounted to one surface are a spray pump and vacuum pump which are connectd to associated apertures in the mounting plate. The output of the vacuum pump exhausts to the atmosphere. The output of the spray pump is attached to a spray nozzle which is in turn attached to a vacuum nozzle which is yet in turn fastened to the first mounting plate. This pump module, thus, contains all of the active parts which would generally need servicing with possible exception of the cleaning of the tank module as discussed hereinafter.

A generally cylindrical vacuum separation tank has attached to one end thereof a second mounting plate which is generally identical in shape to the above mentioned first mounting plate. This cylindrical vacuum separation tank has attached to one side thereof and running the length thereof to form a uniform cross section a cleaning solution tank into which fresh cleaning detergent solution and the like are poured for cleaning.

A vacuum separation tube extends from a first aperture in the second mounting plate upwardly through the tank. The first aperture of the second mounting plate communicates with a corresponding aperture in the first mounting plate which is in turn connected to the vacuum nozzle. A separation tube terminates in an outlet which faces upwardly and downwardly in a V-shape back towards the mounting plates. This shape and orientation help separate the air from the water and debris entrained therein during the vacuum process.

Located immediately above the separation tube are a pair of baffles formed of a perforated metal screen. The baffle screens are separated by a simple cylindrical member which spaces them apart and maintains them in relationship across the cross section of the vacuum separation tank. An end plate is located in the opposite end of the vacuum separation tank from the mounting plates. Located in the end plate is a suction tube which has a slot formed in the top surface thereof for continuing the air suction path. The suction tube extends out the end plate through a U-shaped connector and thence downwardly through the solution tank to an aperture in the second mounting plate which communicates in effect with the inlet of the vacuum pump. This separation system, while relatively simple, is highly effective for separation. A dump valve is provided on the vacuum separation tank adjacent the mounting plates to allow the flushing and cleaning of the separation tank of dirty water and debris. A plug may be located in the opposite end of the vacuum separation tank for adding clean water thereto to assist in such cleanup operations.

The location of the relatively heavy motors and nozzle assemblies in conjunction with wheels which are mounted to the mounting plates provides a low center of gravity, thus resulting in a machine which is easily maneuvered by all types of personnel.

A control module is placed atop the tank module and covers a filler neck which may be used to place solution into the cleaning solution tank. The control module also includes a handle for assistance in maneuvering as well as switches for the vacuum and spray pumps.

These and other objects and advantages of the invention will appear more fully from the following description made in conjunction with the accompanying drawings wherein like reference characters refer to the same or similar parts throughout the several views.

DESCRIPTION OF THE PREFERRED EMBODIMENT

Figure 1:
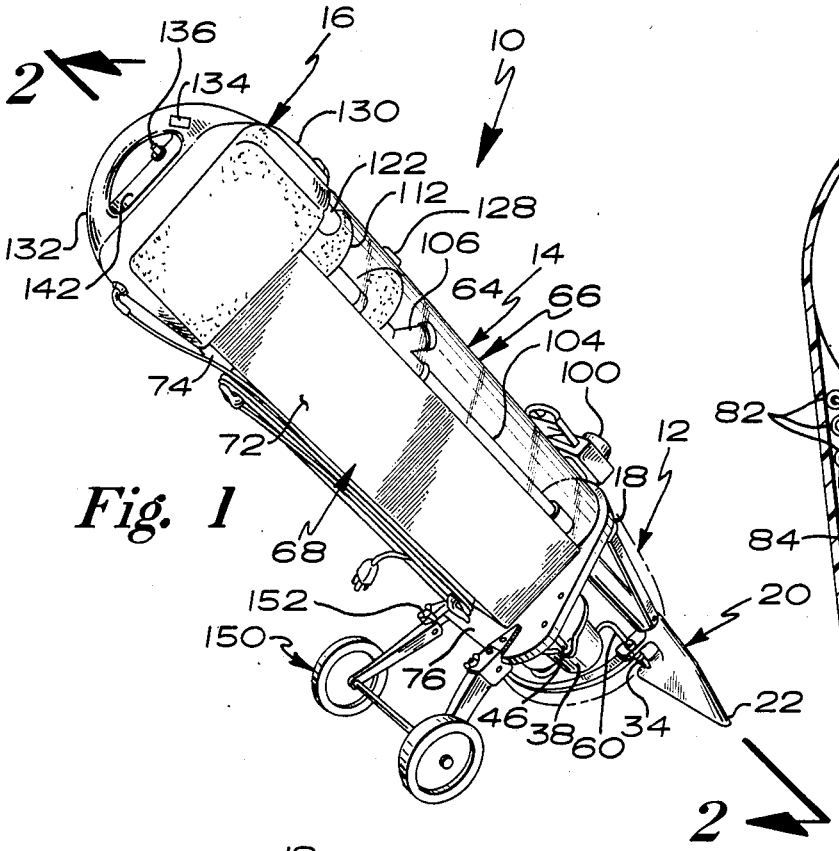
FIG. 1 is a perspective view showing the instant invention.

The instant invention, generally designated 10, is a self-contained apparatus for cleaning carpet or other floor covering. Device 10 is comprised generally of a pump module 12, a tank module 14 and a control module 16. The pump module 12 is comprised generally of a first mounting plate 18 having attached thereto a vacuum nozzle 20 which in turn has a wide floor engaging tip 22 and a mounting flange 24. In aperture 26, mounting plate 18 is provided for communication of the nozzle 20 as will be more fully described hereinafter. A fastener 28 attaches brace 30 to nozzle 20 by means of nozzle flange 36. Brace 30 is attached at its other end to mounting plate 18 by means of fastener 32. A spray nozzle 34 is mounted in nozzle flange 36, spray nozzle 34 being intended to spray a cleaning solution onto the floor covering as will be more fully described hereinafter.

A vacuum motor 38, preferably of a three-stage design, has an intake 40 and an outlet 42. An aperture 44 is provided in first mounting plate 18 for connection to vacuum motor intake 40. A plurality of fasteners 46 mount vacuum pump 38 to first mounting plate 18. A bracket 48 has a mounting flange 50 thereon which is in turn fastened to first mounting plate 18 by a fastener 52. Bracket 48 extends downwardly from first mounting plate 18 and has fastened thereto a spray pump 54 having an inlet 56 and an outlet 58. A hose 60 is attached to spray pump outlet 58 and is in turn attached to spray nozzle 34. Similarly, a short hose 62 is attached to spray pump inlet 56 and a corresponding aperture 63 in first mounting plate 18.

Figure 5:
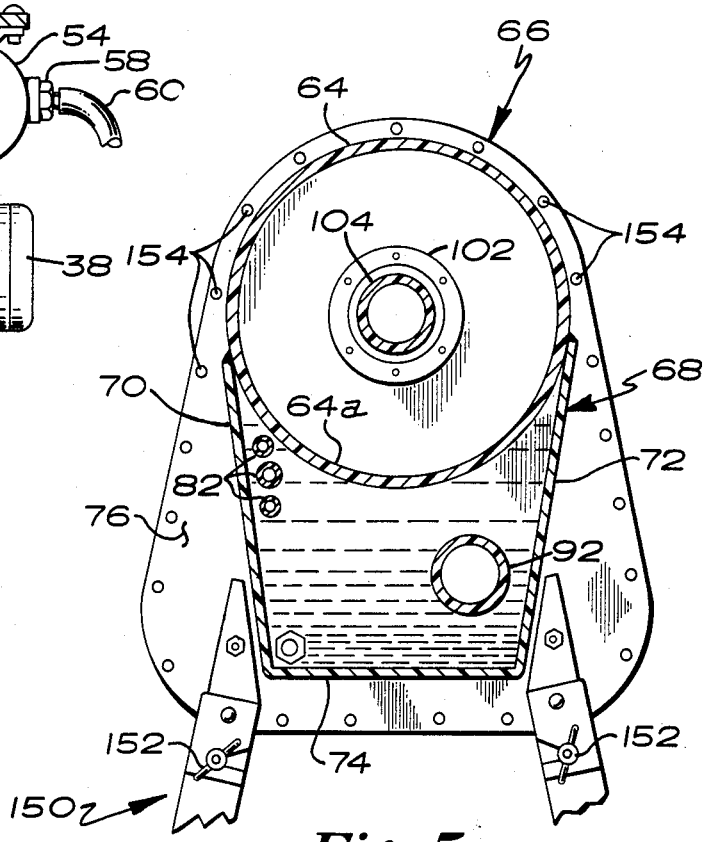
FIG. 5 is a sectional view taken along line 5—5 of FIG. 2.

Tank module 14 is seen in cross section in FIG. 5 and is comprised generally of a round tank wall 64 forming a vacuum separation tank 66. A cleaning solution tank 68 is attached to the side thereof (or may be formed integrally therewith) and is comprised generally of side walls 70, 72 and 74. A divider portion 64a of tank wall 64 serves to divide the two tanks and acts as a wall for both. As can be seen in FIG. 5 in particular and in the other drawings, vacuum separation tank 66 and cleaning solution tank 68 combine to form a generally uniform cross section running from one end to the other. A second mounting plate 76 forms a first end of the tank module 14 and is generally the same shape and size as first mounting plate 18. A top wall 78 closes the top end of cleaning solution tank 68 while a removable lid 80 serves to cover the end of the vacuum separation tank 66 at the end opposite second mounting plate 75. A plurality of conduits 82 run through top wall 78 downwardly through the interior of cleaning solution tank 68 and terminate at second mounting plate 76. Conduits 82 are sealed from the interior of cleaning solution tank 68 to provide a sheltered, dry conduit for wiring or the like as will be discussed more fully hereinafter. A filling tube 84 is located in the top wall 78 of solution tank 68 for adding cleaning solution to solution tank 68.

Figure 4:
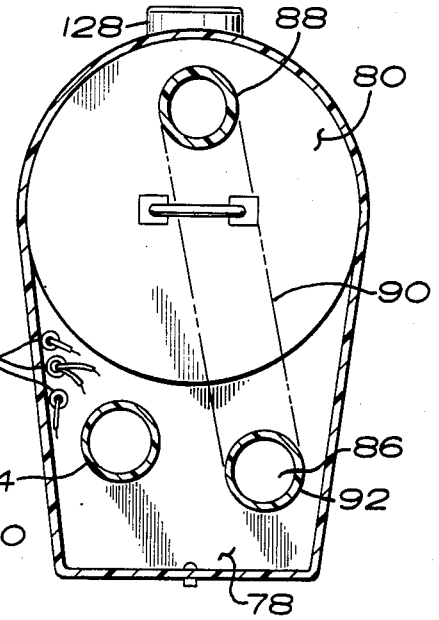
FIG. 4 is a sectional view taken along line 4—4 of FIG. 2.
Figure 3:
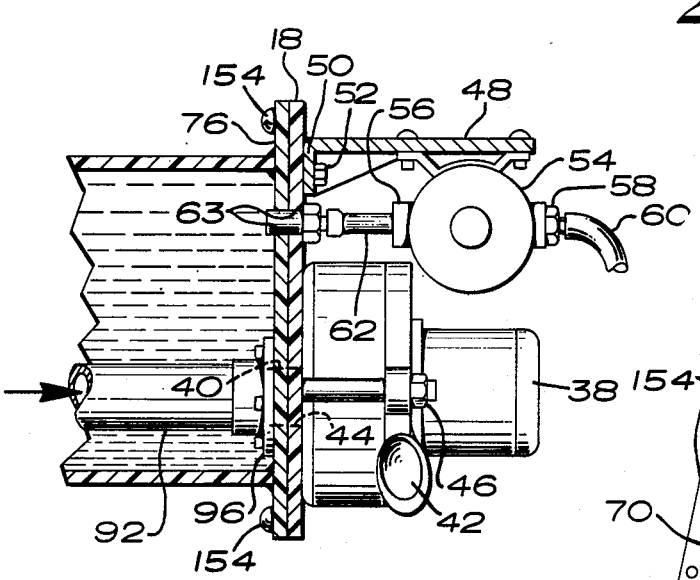
FIG. 3 is a sectional view taken along line 3—3 of FIG. 2.
Figure 2:
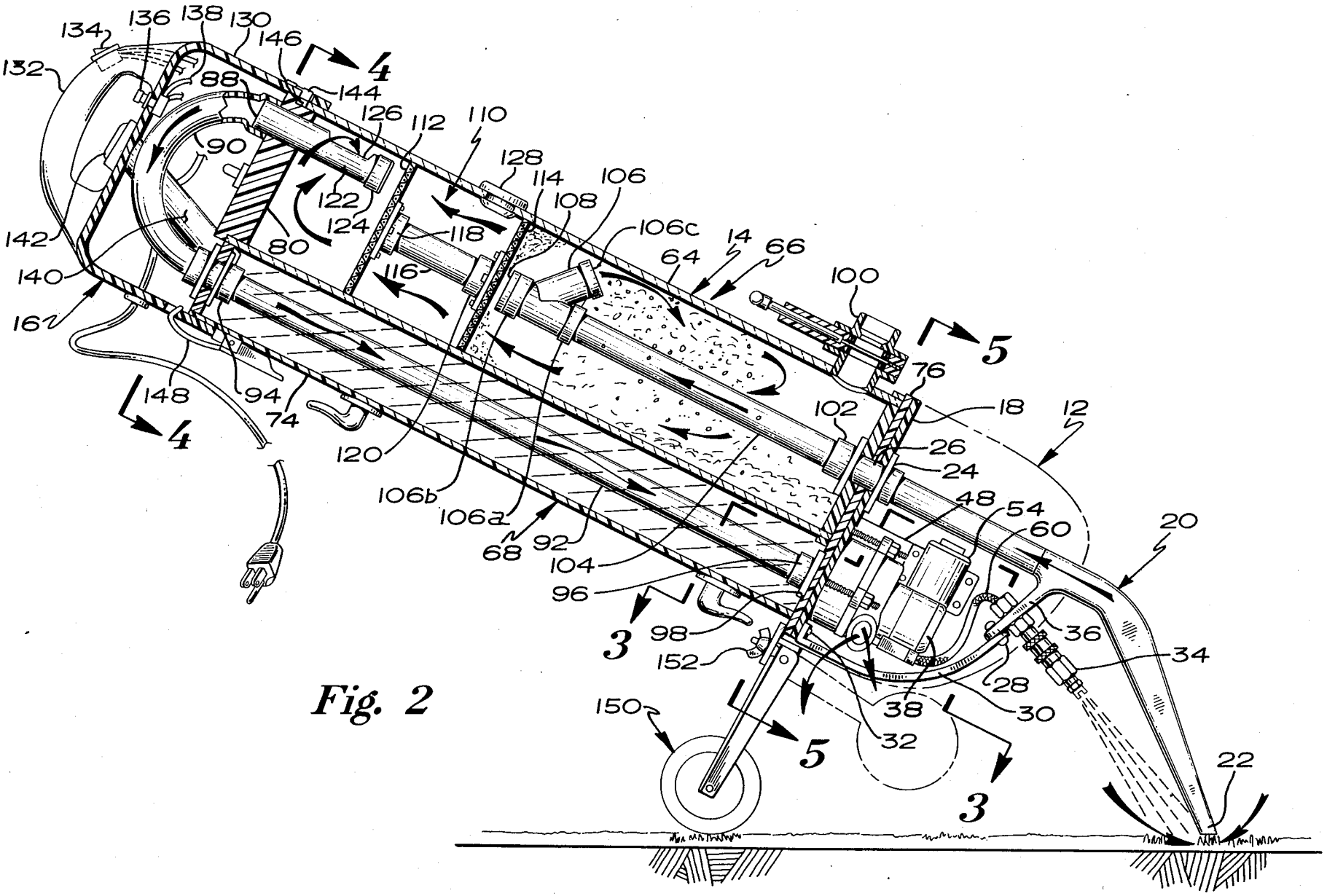
FIG. 2 is a sectional view taken along line 2—2 of FIG. 1.

A vacuum port 86 is also located in top wall 78 and is connected to vacuum port 88 in lid 80 by means of a U-shaped tube 90. A vacuum tube 92 is connected at port 86 and passes downwardly through the interior of the solution tank 68 as shown in FIGS. 2, 4 and 5 and is connected at the ends thereof by means of flanges 94 and 96. An aperture 98 in mounting plate 76 communicates with the vacuum pump intake 40 and the corresponding aperture 44 in first mounting plate 18.

In the preferred embodiment, tank wall 64 is formed of a clean or translucent plastic, allowing observation of how full the separation chamber has become. A simply operated gate valve 100 is located within wall 64 adjacent second mounting plate 76. Thus, when vacuum separation tank 66 is full, valve 100 may be easily operated to drain tank 66. A vacuum separation tube 104 is attached to mounting plate 76 inside vacuum tank 66. Vacuum separation tube 104 extends axially upwardly through the tank 66 where it terminates in a Y-fitting 106, tube 104 being connected to port **106*a*, port 106*b* being closed by a cap 108 and port 106*c* being opened facing upwardly and back partially in the direction of mounting plate 76. A baffle assembly 110 is formed generally of a pair of circular screens 112 and 114 separated by a tube 116 which is attached to screens 114 and 116 by means of flanges 118 and 120, respectively. Screen assembly 110 need not be attached to the tank as such but may be loosely inserted into tank 66 to rest on cap 108**.

A suction tube 122 is located in cap 80 and has over one end thereof a cap 124. A slot-like aperture 126 is located in the top surface of tube 122 as seen in FIG. 2. Tube 122 forms a suction tube and extends upwardly into U-shaped joining piece 90 which curve downwardly to connect suction tube 122 with the upper end of vacuum tube 92

The plug 128 is located in the wall 64 of vacuum tank 66 and may be removed for insertion of a hose or other means of applying fluid to the inside of tank 66 in order to flush and clean it.

Control module 16 is provided generally with a cover 130 which is desirably molded in one piece out of plastic. Cover 130 is provided with a handle 132 for maneuvering of the device 10 and has switches 134 and 136 thereon for operation of the device. Switch 134 is generally of a simple on/off type which may be switched on and which runs vacuum pump 38. Switch 136 is of a momentary "on" type and being connected to spray pump 54. Switches 134 and 136 are connected by means of wiring 138 which runs through conduits 82 and solution tank 68. A fill tube 142 may be used to connect port 84 with cover 130 and is provided with a cap 142 which may be easily removed to add fresh cleaning solution to solution tank 68.

Cover 130 is affixed to tank module 12 by means of a flange 144 on the top of tank module 14 and a latch 148 on the bottom thereof. Of course, this means of attachment may be varied to any number of well known constructions. Lip 144 engages in slot 146 and cover 130. Wheel assembly 150 is provided with a releasable locking latch 152 and is fastened to mounting plates 18 and 76. As can be seen in FIG. 2, wheel assembly 150 may be collapsed as shown in phantom for purposes of transport or storage.

Of course, mounting plates 18 and 76 are fastened together by means of simple fasteners 154 about the periphery thereof, no other connection being necessary.

Operation of the instant invention is quite simple. Initially, of course, the operator will check vacuum separation tank wall 64 to make sure the tank is empty and if not, will operate gate valve 100 to do so. Thence, solution tank 68 is filled by removing cap 142 and pouring the proper cleaning solution through fill tube 140 into cleaning solution tank 68. Cap 142 is then replaced and the operator presses switch 136 to spray cleaning solution from nozzle 34 onto the surface to be cleaned. Switch 134 is then activated which in turn operates vacuum pump 38. Thus, moisture and debris are sucked up through nozzle tip 22 and nozzle 20 and thence upwardly through vacuum tube 104 to fitting 106 whence the water and entrained debris passes upwardly and outwardly through port 106c into the main portion of the vacuum separation tank 66. The flow can be seen as designated by the arrows in FIG. 2. Through the action of gravity, the moisture and debris entrained therein will tend to fall downwardly in separation tank 66 and only the air will continue to move upwardly as shown by the arrows through screens 114 and 112, those screens helping to insure that moisture is removed and drains downwardly to the bottom of separation tank 66. The air then enters suction tube 122 through aperture 126 and thence passes around through U-shaped tube 90 and through tube 92 to vacuum pump 38 whence it exits through outlet 42. When the cleaning operation is completed, the separation tank 66 is then drained using valve 100 and flushed by removing plug 128 is necessary.

While the preferred embodiments of the present invention have been described, it should be understood that various changes, adaptions and modifications may be made herein without departing from the spirit of the invention and the scope of the appended claims.

What is claimed is:

1. A floor cleaning device comprising:

an elongated, generally cylindrical separation tank having first and second ends;

an elongated cleaning solution tank extending generally parallel to said separation tank and having first and second ends;

wheel means adjacent said first ends of said separation tank and said cleaning solution tank for rolling support of said tanks on a floor surface;

a mounting plate extending transversely with respect to said tanks at said first ends thereof and having first and second apertures therethrough;

a vacuum pump having an inlet and an outlet, said inlet being connected through said first aperture to said separation tank by a vacuum tube, and said vacuum pump being supported on said mounting plate forwardly of said first ends of said tanks;

a vacuum nozzle having a tip positioned for suction cleaning of a floor surface, said nozzle being connected by a vacuum separation tube to the interior of said separation tank;

a spray pump having an inlet and an outlet, said inlet being connected through said second aperture with the interior of said cleaning solution tank, and said spray pump being supported on said mounting plate forwardly of said first ends of said tanks; and a spray nozzle connected to said spray pump outlet, said spray nozzle being supportably positioned to direct cleaning solution onto a floor surface.

2. The device of claim 1 further comprising:

a second mounting plate having first and second apertures forming said first end of said cleaning solution tank, said mounting plates being substantially similar in shape and aperture location; and means connecting said plates in parallel contacting relationship with said respective first apertures and said respective second apertures communicating with one another.

3. The device of claim 1 comprising:

a third aperture in said mounting plate; and said vacuum nozzle being connected to said vacuum separation tube through said mounting plate third aperture.

4. The device of claim 1 further comprising a control module located adjacent said second ends of said tanks, said module comprising:

a handle; and means for controlling said pumps.

5. The device of claim 4 further comprising electrical conduit means connecting said control means and said pumps.

6. The device of claim 5 wherein said electrical conduit means passes through said cleaning solution tank from said second end to said first end.

7. The device of claim 6 further comprising a fluid-tight conduit in said cleaning solution tank through which said electrical conduit means pass.

8. The device of claim 1 wherein said separation tube extends from said mounting plate through said separation tank toward said second end thereof and terminates in an outlet within said separation tank.

9. The device of claim 8 wherein said separation tube outlet faces upwardly and toward said mounting plate.

10. The device of claim 8 further comprising at least one separation baffle extending across said separation tank intermediate said separation tube outlet and said separation tank second end.

11. The device of claim 10 comprising at least a pair of said baffles spaced apart from and parallel to one another.

12. The device of claim 10 further comprising a separation tank cover plate closing the end of said separation tank at said second end therof.

13. The device of claim 8 further comprising a suction tube extending through said separation tank cover plate into said separation tank, said suction tube having an opening within said separation tank adjacent said second end thereof and being connected to said vacuum tube for fluid flow communication with said vacuum pump inlet.

14. The device of claim 13 wherein:

at least one air permeable separation baffle extends across said separation tank between said separation tube outlet and said suction tube opening.

15. The device of claim 13 wherein said vacuum tube extends through said cleaning solution tank and is connected adjacent said second end of said cleaning solution tank with said suction tube.

16. The device of claim 1 wherein said wheel means are foldably attached to said mounting plate.

17. The device of claim 1 further comprising a drain valve in said vacuum tank adjacent said mounting plate.

18. The device of claim 1 wherein:

a portion of said mounting plate serves as a closure wall for said first end of said cleaning solution tank.

19. The device of claim 1 wherein:

said spray nozzle is supported from said vacuum nozzle.

20. The device of claim 1 wherein:

said vacuum nozzle is supported on said mounting plate.

* * * * *